United States Patent [19]

Hansen et al.

[11] 4,183,723

[45] Jan. 15, 1980

[54] ROTARY VANE PUMP HAVING MULTI-INDEPENDENT OUTPUTS DUE TO STATOR SURFACES OF DIFFERENT CONTOUR

[75] Inventors: Lowell D. Hansen; Melvin F. Huber, both of Rockford, Ill.

[73] Assignee: Sundstrand Corporation, Rockford, Ill.

[21] Appl. No.: 764,913

[22] Filed: Feb. 2, 1977

Related U.S. Application Data

[63] Continuation-in-part of Ser. No. 573,362, Apr. 30, 1975, abandoned.

[51] Int. Cl.[2] ..... F04B 23/10; F04B 49/08; F04B 23/12; F01C 1/00

[52] U.S. Cl. ..... 417/204; 417/287; 417/288; 417/310; 417/428; 418/15

[58] Field of Search ..... 417/62, 204, 287, 310, 417/426, 428, 288; 418/15, 267, 266, 268, 31, 16, 13

[56] References Cited

U.S. PATENT DOCUMENTS

| | | | |
|---|---|---|---|
| 2,255,782 | 9/1941 | Kendrick | 417/204 |
| 2,280,272 | 4/1942 | Sullivan | 418/15 |
| 2,832,199 | 4/1958 | Adams et al. | 418/15 |
| 3,064,426 | 11/1962 | Furia et al. | 417/287 |
| 3,067,689 | 12/1962 | Hause | 417/288 |
| 3,068,795 | 12/1962 | Lauck | 417/287 |
| 3,578,025 | 5/1971 | Furrer | 137/625.66 |
| 3,752,065 | 8/1973 | Newton | 418/31 |

FOREIGN PATENT DOCUMENTS

| | | | |
|---|---|---|---|
| 163004 | 1/1904 | Fed. Rep. of Germany | 418/13 |

*Primary Examiner*—Carlton R. Croyle
*Assistant Examiner*—Thomas I. Ross
*Attorney, Agent, or Firm*—Wegner, Stellman, McCord, Wiles & Wood

[57] ABSTRACT

A vane-type double lobe hydraulic pump having a casing with a rotor having a plurality of slots with each slot mounting a vane for tracking of a surrounding cam ring and porting for pumping from both undervane and intervane pumping chambers. The cam ring has two generally elliptical sections of different contour whereby the volumes of fluid pumped by the vanes in coacting with one of said sections differ from the pumped volumes of the vanes when coacting with the other section. In one embodiment, there are four independent volume outputs while, in other embodiments, valve elements control the output of the pump whereby it may be the total of the pumped fluid or lesser amounts including only the volume pumped by the vanes in coacting with one of said cam ring sections or only part thereof.

5 Claims, 4 Drawing Figures

ROTARY VANE PUMP HAVING MULTI-INDEPENDENT OUTPUTS DUE TO STATOR SURFACES OF DIFFERENT CONTOUR

CROSS-REFERENCE TO RELATED APPLICATION

This application is a continuation-in-part of application Ser. No. 573,362, filed Apr. 30, 1975, now abandoned.

BACKGROUND OF THE INVENTION

This invention pertains to a vane-type double lobe pump for hydraulic fluid having a variable volume capability derived from different contouring by different radii of curvature of the lobes or sections of a cam ring which control the pumping displacements of the vanes of the pump and with the pumping displacement being derived from pumped volume between vanes, as well as pumped volume from rotor slots beneath the vanes.

A variable volume vane-type pump normally has a cam ring controlling the pumping displacement of the vanes which is movable to various positions with respect to a rotor carrying the vanes, to provide variable volume. Such pumps have required the use of structure for appropriately sealing and movably mounting as well as locating the cam ring dependent upon the desired volume output of the pump.

Applicants have a prior application, Ser. No. 470,988, filed May 17, 1974, now U.S. Pat. No. 3,953,153, which is owned by the assignee of this application, wherein several embodiments of a multiple displacement pump system and method are disclosed. In said prior application, a vane-type pump with a fixed cam ring has pumping action derived by pumping from spaces between vanes as well as from the rotor slots beneath the vanes. The pump is of the double lobe type and with the cam ring having two elliptical sections of the same contour. The variable volume capability is obtained by utilizing the total flow from both the intervane and undervane pumping spaces or using only one or the other, with the volume that is not to be utilized being returned to the inlet means for the pump. In these structures, the variation in volume is obtained by selectively between use of either the undervane slots or the intervane spaces. When pumping volume is obtained from the undervane spaces, only, there is leakage to the intervane spaces past the vanes from the rotor slots which reduces pump efficiency. Additionally, there is no disclosure in the structures of said prior application for providing four different volume rates for the pump.

The Adams et al U.S. Pat. No. 2,832,199 discloses a single lobe vane-type pump wherein plural volumes are taken from the pump by having plural outlet ports arcuately spaced along the arc of travel of the vanes whereby an outlet line connected to each of the outlet ports receives a selected amount of the pumped volume. This patent does not show a double lobe vane-type pump with plural volume outputs from intervane and undervane spaces, nor selective volume control.

SUMMARY OF THE INVENTION

A feature of the invention is to provide a double lobe vane-type pump having a fixed cam ring and with four different volume outputs derived from volume output from two series of intervane pumping spaces and two series of undervane pumping spaces in the rotor slots beneath the vanes and with two differently contoured sections of the cam ring providing for differing pumping displacement of the vanes when coacting with the respective sections.

Another feature of the invention is to provide a double lobe vane-type hydraulic pump having variable volume capability wherein the vanes of the pump track along two differently contoured, generally elliptical sections or lobes of a cam ring whereby the pump volume of the intervane spaces and the undervane spaces when the vanes track one of said sections is different from the volumes when the vanes track the other section.

More particularly, with a pump as defined in the preceding paragraph, there are four different output volumes derived from the two series or sets of pumping chambers defined by the intervane spaces when coacting with said two sections and two series or sets of additional pumping chambers derived from the undervane spaces when the vanes are coacting with the two sections.

A further feature of the invention is to provide a common outlet for the intervane and undervane pumping spaces when the vanes are coacting with one section of the cam ring and a common outlet for the intervane and undervane spaces when the vanes are coacting with the other section of the cam ring and with control means providing for utilization of the total volume derived from both of said common outlets or providing for less than total flow from one or both of said common outlets including zero utilization of the flow from at least one of said common outlets.

In achieving the result defined in the preceding paragraph, the flow through one common outlet is reduced by returning part or all of said flow to an inlet of the pump and with said control being derived from the use of valve means responsive to a pressure in the circuit which utilizes the fluid to have certain variations in fluid pressure in the utilization circuit cause variations in return of fluid to the inlet for the pump and thus change the total volume supplied to the utilization circuit.

An additional feature of the invention is to provide a pump having the capability of providing different volumes of flow from two outlets and wherein the pump is of an unbalanced dual lobe asymmetrical construction with two lobes of different contour which impart the same smoothness and acceleration characteristics to the movable vanes.

DESCRIPTION OF THE PREFERRED EMBODIMENTS

Figure 1:
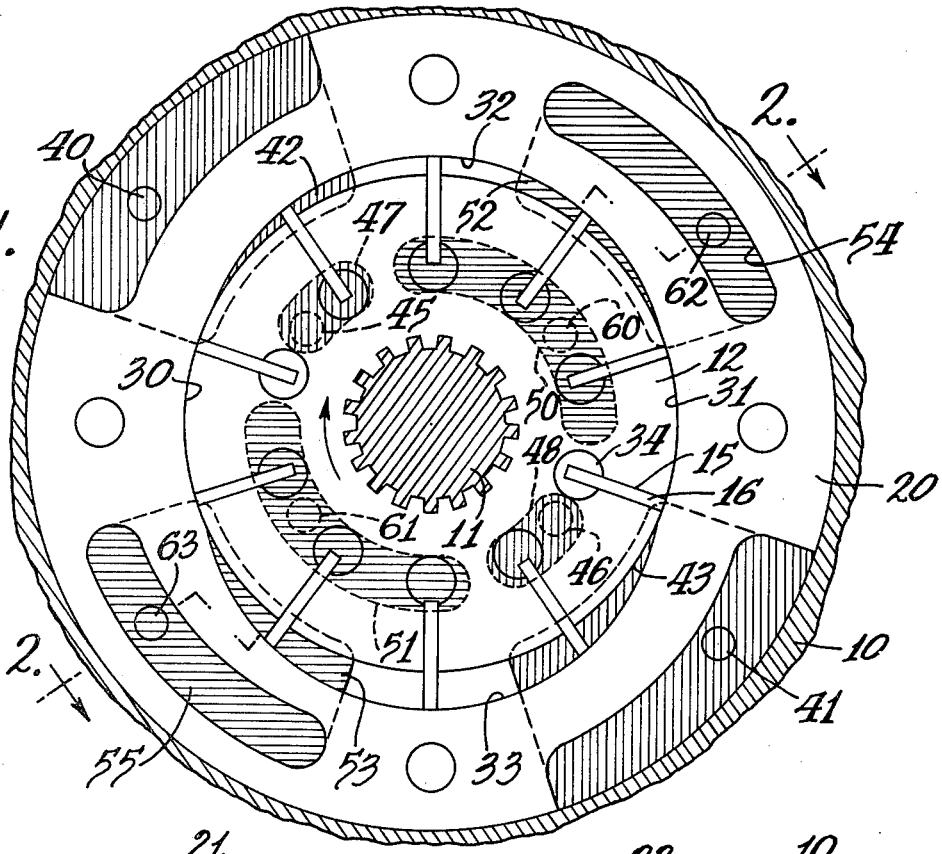
FIG. 1 is a vertical section, taken transversely of the axis of rotation of the rotor of one embodiment of the pump, and taken generally along the line 1—1 in FIG. 2 and with different shading to show inlet and outlet.
Figure 2:
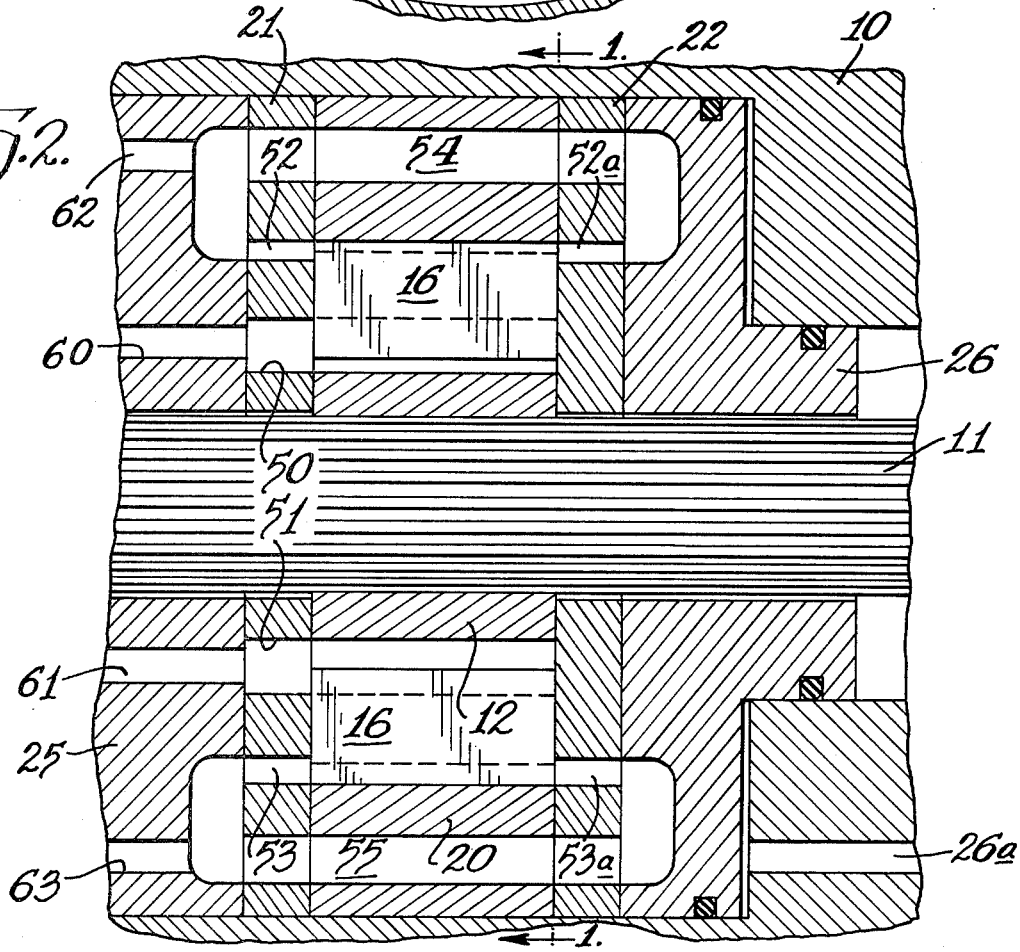
FIG. 2 is a section, taken generally along the line 2—2 in FIG. 1.

A first embodiment of the invention is shown in FIGS. 1 and 2 wherein a casing 10 has an internal chamber, with a pump shaft 11 extending therethrough. A cylindrical rotor 12 is mounted on the pump shaft 11 and has a plurality of rotor slots 15 with enlarged base areas 34 extending generally radially outward to the surface of the rotor. Each of said slots reciprocally mounts an extensible pumping element 16 in the form of a vane. In rotation of the rotor 12, the vanes 16 track a cam ring 20 mounted within the casing 10 and having port plate means positioned to either side thereof, including a port plate 21 and a port plate 22. As shown in FIG. 2, port plates 21 and 22 are held in association with the rotor 12 and against the cam ring 20 by hydraulic clamping between an end cap 25 and a pressure-loaded member 26 engaging the port plates 21 and 22, respectively. Pressure fluid may be delivered through a passage 26*a*. Alternatively to the hydraulic clamping as shown, the port plates 21 and 22 may be held in assembled relation to the cam ring 20 by bolts (not shown) extended therethrough.

The contouring of the cam ring 20 is a particular feature of the invention wherein the two lobes or sections of the cam ring which control the tracking of the vanes 16 are of a differing contour. As shown in FIG. 1, the internal surface of the cam ring 20 has a pair of crossover points, indicated generally at 30 and 31, with there being an upper lobe 32 and a lower lobe 33 as viewed in the Figure. The upper lobe 32 is generally elliptical, with there being a change in the lobe from minor to major radius of a predetermined value, dependent upon the desired action of the vanes 16 when coacting with the lobe 32. The second lobe 33 has a greater change from minor to major radius than lobe 32, as shown in FIG. 1. The pump utilizes pumping chambers provided by intervane spaces, namely the spaces between vanes, which provide a swept volume and also pumping chambers provided by undervane spaces and the reciprocal action of the vanes 16 in the rotor slots 15.

More particularly, the port plate means provides four arcuate inlet ports to the pump, with two of the inlets being inner inlet ports selectively communicating with the first pumping chambers defined by the rotor slots 15 and the enlarged bases 34 thereof. Additionally, there are first and second outer inlet ports selectively communicating with second pumping chambers defined by the intervane spaces. These inlet ports may be provided in both of the port plates 21 and 22, or the cam ring 20. As shown in FIGS. 1 and 2, they are provided in the port plate 21, with there being inlet passages 40 and 41 supplying fluid to the outer inlet ports 42 and 43, respectively. A pair of fluid passages 45 and 46 supplies fluid to the inner inlet ports 47 and 48.

There are four arcuate outlet ports which may be provided in both of the port plates 21 and 22, but, as shown, certain ports are provided only in the port plate 21. There are the inner outlet ports 50 and 51 for the undervane chambers. A pair of outer outlet ports, associated with the intervane chambers, is shown at 52 and 53. Outlet ports 52 and 53 may also be in the cam ring 20. There are similar ports 52*a* and 53*a* in port plate 22 and with communication therebetween by a pair of slots 54 and 55 in the cam ring 20.

The end cap 25 has four outlet passages 60, 61, 62, and 63 communicating with the respective pairs of inner outlet ports 50 and 51 and outer outlet ports 52 and 53, respectively. Thus, the pump has the capability of separate utilization of pumped volume from intervane and undervane pumping spaces and with all four volumes differing in amount because of the different contour of the cam ring lobes 32 and 33.

With the rotor 12 rotating in the direction of the arrow shown in FIG. 1, hydraulic fluid, such as jet engine fuel is delivered through inlet passages 40 and 41 to the outer inlet ports 42 and 43 and through passages 45 and 46 to the inner inlet ports 47 and 48. Referring to the action with respect to the section 33 of the cam ring, the vanes 16 track the section past the lower dead center position of maximum extension of the vane and with pumping displacement occurring when the vanes 16 go past the edge of outlet port 53. The swept volume of fluid from the intervane spaces is pumped to the outer outlet port 53 and the undervane pumping chambers pump fluid to the outlet port 51 by inward movement of the vanes in the rotor slots, as caused by the cam ring. As the vanes 16 coact with the section 32 of the cam ring, the pumping displacement commences when the edge of vane 16 passes the edge of outlet port 52, as shown in FIG. 1, with the intervane spaces pumping to the outer outlet port 52 and the undervane spaces pumping to the inner outlet port 50. With there being a lesser change from minor to major radius for the lobe 32 than for lobe 33, it will be seen that each of the intervane spaces has a lesser volume when the vanes are tracking lobe 32 than when the vanes are tracking lobe 33, so that there is a lesser swept volume carried to outlet port 52 than to outlet port 53. Similarly, there is a lesser stroke of the vanes coacting with lobe 32 than with lobe 33 whereby there is a smaller volume of fluid received in the rotor slots beneath the vanes, including the enlarged ends 34 thereof, whereby a lesser volume of fluid is delivered to the inner outlet port 50 than to the inner outlet port 51.

With the pump shown in FIGS. 1 and 2, four different pumped volumes can be obtained from the pump and which are derived from a fixed cam ring 20 and which has two generally elliptical sections of differing contour.

Any bearing loads that may be generated may be accounted for in the specific structural design of the pump.

Figure 3:
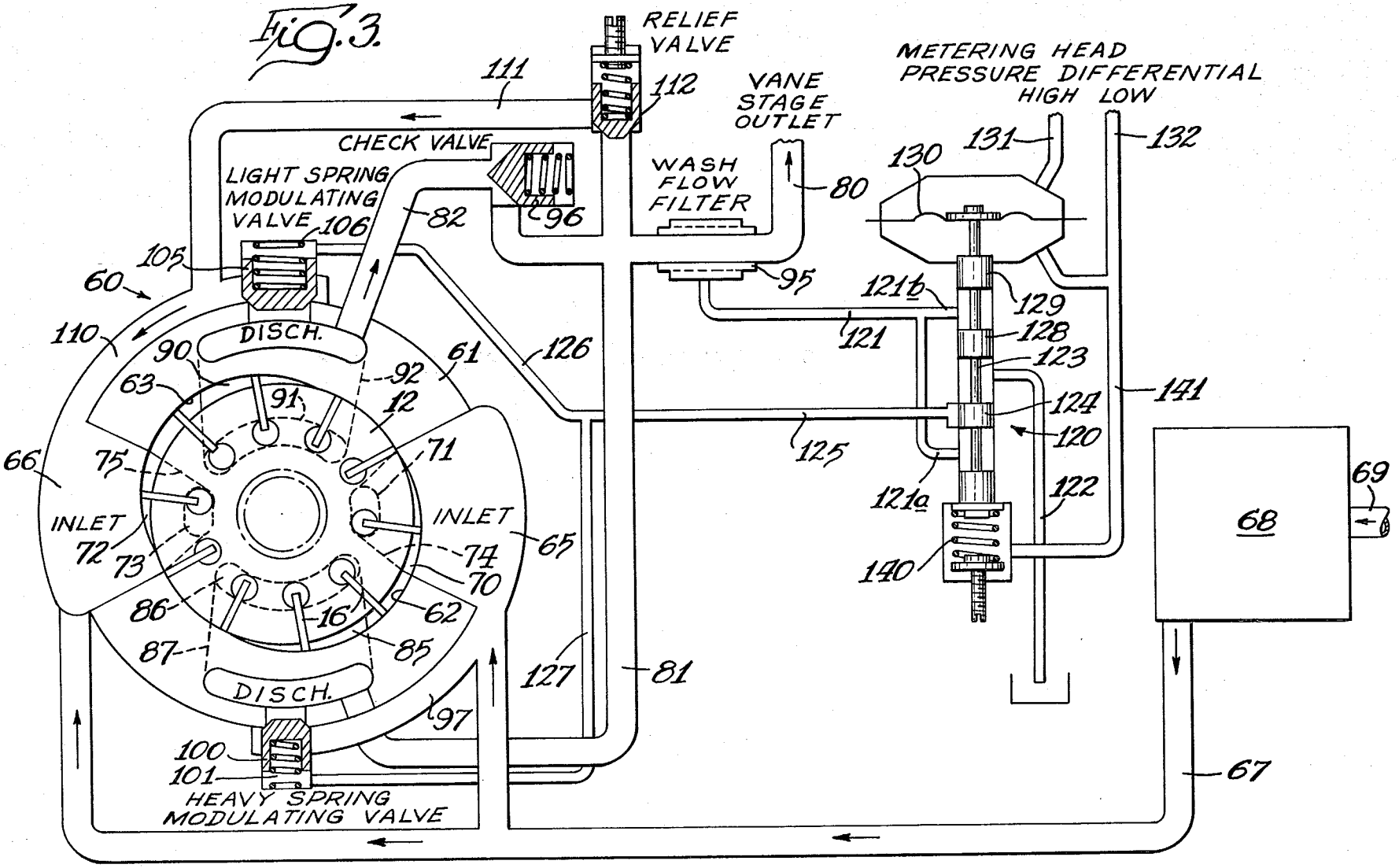
FIG. 3 is a schematic view of a vane-type double lobe pump of a second embodiment and a control circuit associated therewith for obtaining a variable volume output from the pump.

In the embodiment of FIG. 3, the pump, indicated generally at 60, is of the same basic configuration wherein a cam ring 61 has a pair of lobes, or sections, 62 and 63 corresponding to lobes 32 and 33 of the pump of FIG. 1, which are generally elliptical in shape and of differing contour whereby to provide the different pumping volumes as described in connection with the pump of FIG. 1. The pump 60 has a first inlet 65 and a second inlet 66 both supplied from a line 67 leading from a boost pump 68 having an inlet line 69 from a source of fluid. The inlet 65 serves both an outer inlet port 70 and an inner inlet port 71 corresponding to inlet ports 42 and 47 of the pump of FIG. 1. The inlet 66 supplies an outer inlet port 72 and an inner inlet port 73 which are comparable to the inlet ports 43 and 48 of the pump of FIG. 1. The inlet ports of each set are interconnected by a suitable channel, shown by broken lines 74 and 75, respectively.

The output of the pump is delivered to a line 80 leading to a fluid utilization circuit, such as the fuel control for a jet engine, with the supply to the line 80 being through a pair of common outlets 81 and 82 which extend from the pump 60. The common outlet 81 connects to an outer outlet port 85 and an inner outlet port 86 through a connecting channel 87. The common outlet 82 connects to an outer outlet port 90 and an inner outlet port 91 through a connecting channel 92. Thus, with rotation of the pump rotor in a clockwise direction, there is both intervane and undervane pumping action between the fluid inlet 65 and the common outlet 81 and, similarly, between the fluid inlet 66 and the common outlet 82, with the flow to each outlet being a sum of the intervane and undervane pumping and with the volume of fluid delivered to common outlet 81 being less than that delivered to common outlet 82 because of the differing contours of the lobes 62 and 63. The common outlets 81 and 82 join together and connect to the line 80 with there being flow of the fluid through a wash flow filter 95 and with there additionally being a check valve 96 in common outlet 82 which prevents flow from common outlet 81 to common outlet 82 when the outlet pressure is low.

The pump 60 has an additional pair of alternate fluid flow paths, with one alternate path being from fluid outlet ports 85 and 86 back to the fluid inlet 65 through a passage 97, with this flow being under the control of a modulating valve 100 urged to a closed position by a spring 101. When this valve opens, fluid may flow back to the fluid inlet 65 for recycling through the pump. A second modulating valve 105 is urged to a closed position by a spring 106, which is of a lesser force than the spring 101. The modulating valve 105 blocks flow from the outlet ports 90 and 91, but, when open, permits flow along a passage 110 back to the fluid inlet 66 for recycling through the pump. This passage 110 also communicates, through a line 111, with the downstream side of a relief valve 112 which may be set to establish a maximum pressure in the outlet flow line 80. The different force values of the springs 101 and 106 provide for opening of the modulating valve 105 prior to opening of the modulating valve 100. The two modulating valves are of a different size, with valve 100 being smaller because of being associated with the lesser volume section of the pump.

An additional control is put on the opening of the modulating valves by means of a control circuit, including a servo control valve, indicated generally at 120. The control valve is supplied with a control pressure from pumped fluid at the wash flow filter 95 through a line 121 and the valve has a line 122 to tank. A valve spool 123 of the control valve has a land 124 which meters the pressure from a branch line **121*a* of line 121 and delivers an intermediate pressure to a line 125 which has branches 126 and 127 leading to the modulating valves 105 and 100, respectively. A second branch 121*b* of the control pressure line 121 leads to the control valve between a land 128 and a land 129 whereby a pressure differential prevents impurities in the fuel from moving downwardly past the land 129** into the control area of the valve.

The position of the valve spool 123 is controlled by a pressure differential applied to a diaphragm 130 which provides amplification of the pressure differential. A pair of lines 131 and 132 connect to opposite sides of the diaphragm and extend from opposite sides of a variable geometry orifice in a fuel control whereby a predetermined difference in pressure results in a downward shift of the diaphragm to lower the valve spool 123. When the valve spool 123 is in an upper position, the intermediate pressure in line 125 is relatively high and is applied to the back side of both of the modulating valves to assist the springs and maintain the modulating valves closed. When the pressure differential between lines 131 and 132 is sufficient to deflect the diaphragm 130 downwardly, the valve spool land 124 moves to a position to meter the flow to line 125 to reduce the intermediate pressure and, at a certain value, the modulating valve 105 will open whereby part of the pump flow passes through passage 110 and back to the fluid inlet 66. If the intermediate pressure reduces further, the modulating valve 105 will open further and ultimately the intermediate pressure may be reduced to a value whereby the modulating valve 100 may also open.

At start-up, there will be no intermediate pressure, since there is no pressure in line 121.

A spring 140 urges the valve spool 123 to the upper position to connect passage **121*a* to passageway 125 to maintain the modulating valves 100 and 105 in a closed position. Additionally, a branch line 141 from line 132 extends to the lower side of the valve spool whereby the force of the pressure in line 132 directed to the underside of the diaphragm and acting against valve land 129** is balanced out so as to not affect valve positioning.

The circuit of FIG. 3, as an example, may be used in supplying an aircraft engine fuel system whereby there are ranges of flow requirements from a minimum flow at flight idle descent to a maximum flow at maximum rated thrust. In such an application, the flow from common outlet 81 would be of a volume to provide the lower flow engine requirements and the flow would be from both common outlets 81 and 82 at full flow for maximum flow at maximum rated thrust. This system provides for a variable volume delivery with higher over-all efficiency without requiring the use of a variable displacement pump with an adjustable cam ring, and its associated lower over-all efficiency. Additionally, higher volumetric efficiency is obtained than from the system disclosed in the prior application of applicants, referred to above, since there is always pumping in the intervane spaces at the same time that there is pumping in the associated undervane spaces. This avoids a substantial pressure differential between the undervane spaces and the intervane spaces, whereby leakage around the vane edges from the base of the rotor slots to the spaces between vanes is minimized. This improved volumetric efficiency enables the pumping at higher pressures.

Figure 4:
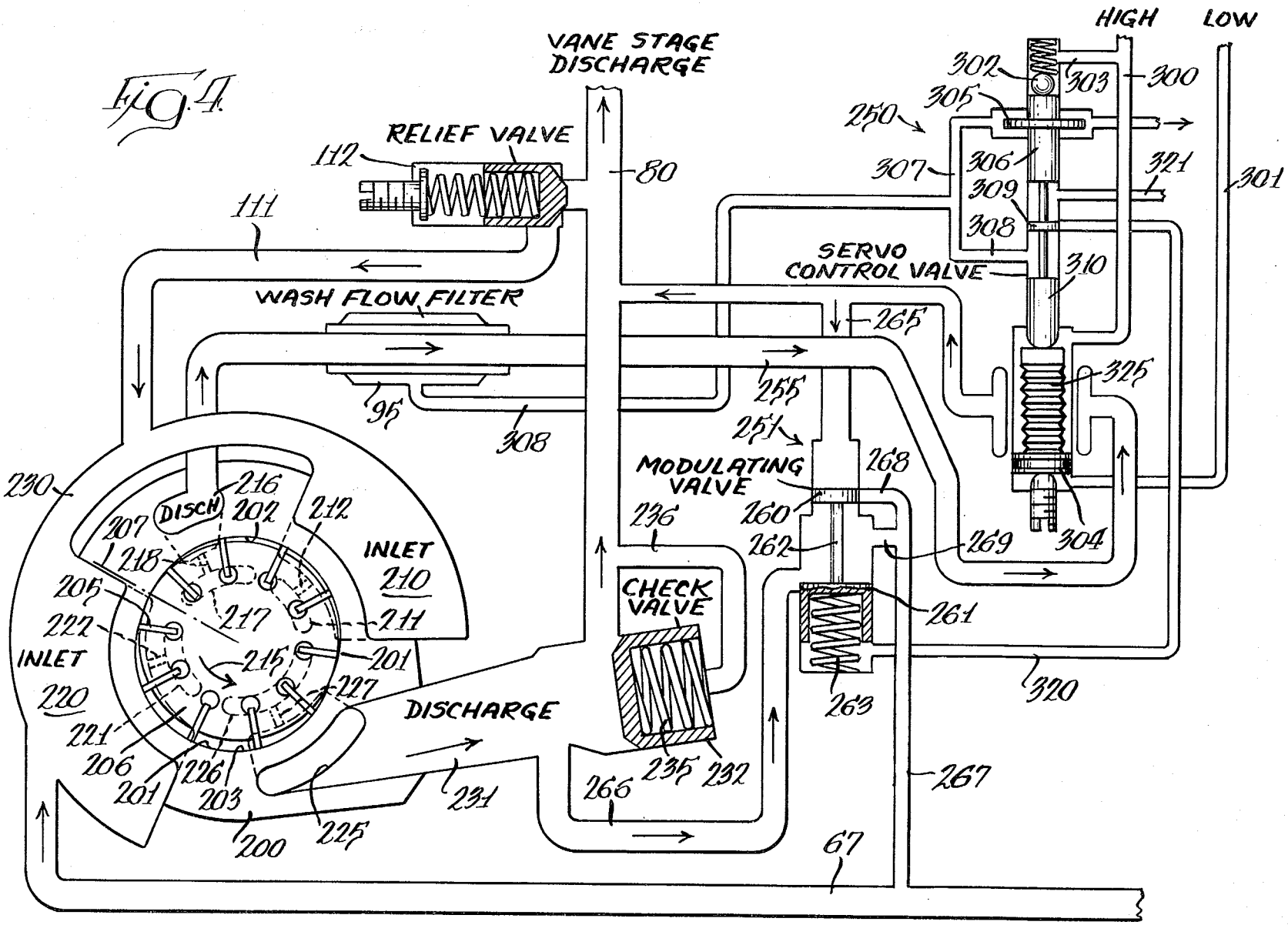
FIG. 4 is a schematic view of an unbalanced dual lobe asymmetrical pump and another embodiment of the control circuit associated therewith for obtaining a variable volume output from the pump.

In the embodiment of FIG. 4, the pump disclosed differs from that shown in the other embodiments in that the pump is of an unbalanced, dual lobe, asymmetrical design with the pump 200 having a cam ring 201 with a pair of lobes or sections 202 and 203 which are generally elliptical in shape and of differing contour to provide the different pumping volumes as described in connection with the pumps of FIGS. 1 and 3. The pump 200 differs from the other pumps in having the lobes 202 and 203 extending for differing degrees of arc of the cam ring 201 whereby the slopes of the lobes are substantially the same whereby a plurality of the pump vanes 205 that are movably mounted in a slotted rotor 206 and which are tracking the cam ring lobes 202 and 203 may accelerate at the same rate to impart smoothness characteristics in operation of the pump. A broken line 207 extended through the axis of the rotor 206 and through a crossover area between the lobes 202 and 203 assists in visualizing the unequal value of degrees of arc that are occupied by the two lobes. The lobe 202 has an effective length less than that of the lobe 203. With the lobe 203 having the greater pumping capability because of the greater radial outward extent of the cam ring surface, the vanes 205 must move outwardly further when coacting with the lobe 203 and with the greater arcuate extent of this lobe the slope of the cam ring surface at the lobe 203 can be the same as the slope of the cam ring surface at lobe 202.

The unbalanced, dual lobe, asymmetrical pump 200 has an inlet zone 210 communicating with port means supplying fluid to the intervane pumping spaces between the vanes 205 and a connecting passage 211 supplying a port 272 for supplying fluid to undervane pumping spaces beneath the vanes 205. With the direction of pump rotation indicated by the arrow 215, the vanes 205 track the cam ring lobe 202 with discharge of pump fluid from an outlet 216 which connects to the intervane pumping spaces and also from the undervane pumping spaces through a port 217 and a connecting passage 218.

A second inlet zone 220 supplies the intervane pumping spaces coacting with the cam ring lobe 203 and supplies the undervane pumping spaces through a port 221 and a connecting passage 222. The pumped fluid is delivered to a discharge outlet 225 which communicates with the intervane pumping spaces and with the undervane pumping spaces through a port 226 and a connecting passage 227.

The control of flow from the pump is by means of a circuit generally similar to that shown in FIG. 3, with a different construction of the modulating valve means and of the servo control valve and operating structure therefor. The structure of the circuit similar to that shown in FIG. 3 has been given the same reference numeral including a line 67 which extends to the pump inlets 210 and 220 through an interconnecting passage 230. The pump supplies a discharge line 80. The line 80 is supplied from the pump discharge 225 through a connecting line 231 which has a check valve 232, shown in open position, but operative to move to the left, as viewed in FIG. 4, to block flow from outlet line 80 to the line 231 when there is no effective flow from pump discharge 225 to the outlet line 80. This prevents flow from pump discharge 216 flowing to tank through the modulating valve means when the discharge from pump outlet 225 is connected to tank. Check valve 232 has a relatively light spring 235 urging the check valve closed and the positioning of the check valve is controlled from a control line 236 connected between the back side of the check valve and the outlet line 80.

The outlet line 80 has a normally closed relief valve 112 which, upon opening, will permit flow from the outlet line 80 back to the pump inlets through a branch line 111.

The servo control valve is indicated generally at 250 and the modulating valve means at 251. The flow from pump discharge outlet 216 flows through a line 255 extending through a wash flow filter 95, with the line 255 passing around a section of the servo control valve 250 to provide thermal compensation for structure of the servo control valve to be described and the line then connects into the outlet line 80.

The modulating valve means 251 has a pair of lands 260 and 261 of differing size and connected by a common stem 262 and a spring 263 urging the valve land upwardly as viewed in FIG. 4. A branch line 265 branches from the discharge line 255 to apply pressure in the common outlet line 80 against the valve land 260. A branch line 266 extends from the discharge line 231 leading from the pump discharge 225 to a central part of the modulating valve means. A line 267 extends from the modulating valve means to the inlet line 67 and has a pair of connecting lines 268 and 269 to the modulating valve means for receiving flow therefrom, depending upon the position of the valve lands 260 and 261.

Upon start-up of the system, the spring 263 will have the valve lands 260 and 261 in their uppermost position and above the position shown in FIG. 4. In this condition, the branch lines 265 and 266 will be blocked from communication with the connecting lines 268 and 269 which lead back to the inlet line 67. As pressure of fluid in the outlet line 80 builds up, and dependent upon the value of the variable control pressure to be described, the valve lands move downwardly toward the position shown in FIG. 4, with the result that the branch line 266 is connected to the connecting line 269 whereby part of the flow from the pump discharge 225 can return to the inlet line 67. Further movement to the position of FIG. 4 and therebeyond increases the return of pump flow from pump discharge 225 back to the inlet line 67. After complete return of flow from pump discharge 225 back to the inlet line 67, further lowering movement of the valve lands 260 and 261 will result in connection of branch line 265 to the connecting line 268 whereby part of the flow delivered from pump discharge 216 will also be delivered to the inlet line 67. This amount of return flow will increase as the valve land 260 moves downwardly.

With this construction, it will be seen that the pump 200 having two fixed displacement pumping sections can be controlled to effectively operate as a variable displacement pump.

The pump flow delivered from the pump has many different uses. However, the circuit as disclosed may be used in supply of fuel at variable volumes to an engine and the servo control valve 250 is responsive to a differential pressure set through fuel control means not shown and which delivers a pressure differential signal to the servo control valve 250 including the higher pressure signal through a line 300 and the lower pressure signal through a line 301, with the higher pressure signal being applied against a spring-urged ball 302 through a branch passage 303 and the low pressure signal being applied to the underside of a piston 304. The servo control valve includes a turbine wheel 305 connected to the stem 306 of the valve and supplied with flow from the wash flow filter through a line 307 to cause a spinning of the stem 306 for accurate positional control thereof. The line 307 has a branch 308 acting between lands 309 and 310 for delivering fluid to the servo control valve. A variable pressure signal passes through a line 320 to the underside of the modulating valve means 251 with the value of this signal being dependent upon the position of the valve land 309 which, in its various positions between the pressure signal line 320 and a line 321 leading back to the tank, determines the value of the pressure signal delivered to the modulating valve. The valve stem 306 has the lands 309 and 310 integral therewith and its lower end beneath the valve land 310 engages against a bellows member 325 positioned within a chamber which receives the higher pressure signal. The bellows is a motion-transmitting connection between piston 304 to the lower end of the valve stem whereby the position of the valve land 309 is determined by the differential pressure acting against the ball 302 and the piston 304 through the motion-transmitting connection bellows 325. The bellows 325 gives a spring effect and the effect thereof is also modified by the thermal compensating action by the flow passage 255 extending therearound as previously mentioned.

The operation of the circuit shown in FIG. 4 is the same as that shown in FIG. 3, with the primary difference being in the construction of the modulating valve means to have the modulating valve member lands 260 and 261 connected by a common stem and subject to a variable pressure signal delivered through line 320.

The comments given with respect to the structure shown in FIG. 3 as to improvements in structure and operation apply equally to the structure shown in FIG. 4, with the further improvement of the smoothness characteristics in the pump structure because of the unbalanced, dual lobe, asymmetrical design. Additionally, it will be noted that the pump has the inlet sections of each pumping section of different arcuate extent than the discharge zone of the same pumping section.

We claim:

1. A vane-type double lobe hydraulic pump having a casing; a rotor within said casing and having a plurality of generally radially extending slots and a plurality of extensible vanes movably mounted at least one in each of said slots; means providing first and second inner inlet ports selectively communicating with first pumping chambers defined by said rotor slots beneath the vanes, first and second outer inlet ports selectively communicating with second pumping chambers defined by spaces between vanes, first and second inner outlet ports selectively communicating with said first pumping chambers, and first and second outer outlet ports selectively communicating with said second pumping chambers; a pre-formed cam ring surrounding said rotor and having a pair of generally elliptical sections of different radius of curvature to provide a total pumping volume for said first and second pumping chambers when operatively associated with one of said elliptical sections which differs from the total pumping volume when operatively associated with the other of said elliptical sections, said generally elliptical sections being associated one with the first inner and outer inlet ports and the other with the second inner and outer inlet ports; and a pair of casing outlet passages extending one from each of said first and second outer outlet ports.

2. A pump as defined in claim 1 wherein each of said inner and outer outlet ports has an outlet passage in said casing separate one from the other.

3. A pump as defined in claim 1 wherein said first inner outlet port and first outer outlet port have a first common outlet and said second inner outlet port and second outer outlet port have a second common outlet.

4. A vane-type double lobe hydraulic pump having a casing; a rotor within said casing and having a plurality of generally radially extending slots and a plurality of extensible vanes movably mounted at least one in each of said slots; means providing first and second inner inlet ports selectively communicating with first pumping chambers defined by said rotor slots beneath the vanes, first and second outer inlet ports selectively communicating with second pumping chambers defined by spaces between vanes, first and second inner outlet ports selectively communicating with said first pumping chambers, and first and second outer outlet ports selectively communicating with said second pumping chambers; a cam ring surrounding said rotor and having a pair of generally elliptical sections of different radius of curvature to provide a total pumping volume for said first and second pumping chambers when operatively associated with one of said elliptical sections which differs from the total pumping volume when operatively associated with the other of said elliptical sections; said pair of generally elliptical sections extending for different degrees of arc of the cam ring whereby the vanes tracking each section may accelerate at the same rate; a pair of casing outlet passages extending one from said first inner and outer outlet ports and the other from said second inner and outer outlet ports; a fluid utilization line connected to said pair of casing outlet passages, modulating valve means including a valve element associated one with each casing outlet passage ahead of said fluid utilization line, and control pressure means for sequencing the action of said modulating valve means to provide a variable volume pump action.

5. A vane-type double lobe hydraulic pump having a casing; a rotor within said casing and having a plurality of generally radially extending slots and a plurality of extensible vanes movably mounted at least one in each of said slots; means providing first and second inlet ports selectively communicating with pumping chambers defined by spaces between vanes, and first and second outlet ports selectively communicating with said pumping chambers; a cam ring surrounding said rotor and having a pair of generally elliptical sections of different radius of curvature to provide a total pumping volume for said pumping chambers when operatively associated with one of said elliptical sections which differs from the total pumping volume when operatively associated with the other of said elliptical sections; said pair of generally elliptical sections extending for different degrees of arc of the cam ring to provide a slope for the cam ring surface in each of said sections which is the same to have the same acceleration rate for vanes acting at each section; a pair of casing outlet passages extending one from said first outlet port and the other from said second outlet port; a fluid utilization line connected to said pair of casing outlet passages, modulating valve means including a valve element associated one with each casing outlet passage ahead of said fluid utilization line, and control pressure means for sequencing the action of said modulating valve means to provide a variable volume pump action.

* * * * *